US012805583B1

(12) United States Patent
Xu et al.

(10) Patent No.: US 12,805,583 B1
(45) Date of Patent: Nov. 24, 2026

(54) LOWER GARMENT WITH AN INTEGRATED CROSS-ELASTIC STRUCTURE

(71) Applicant: POPILUSH, LLC, Williamsburg, VA (US)

(72) Inventors: Zhennan Xu, Xiamen City (CN); Rongqing Xu, Xiamen City (CN); Jun Zeng, Xiamen City (CN); Boxian Yang, Zhangzhou City (CN)

(73) Assignee: POPILUSH, LLC, Williamsburg, VA (US)

( * ) Notice: Subject to any disclaimer, the term of this patent is extended or adjusted under 35 U.S.C. 154(b) by 0 days.

(21) Appl. No.: 19/345,138

(22) Filed: Sep. 30, 2025

(30) Foreign Application Priority Data

Sep. 16, 2025 (CN) ..... 202521987570.4

(51) Int. Cl.

| | |
|---|---|
| ***A41D 1/06*** | (2006.01) |
| ***A41C 1/08*** | (2006.01) |
| ***A41D 1/14*** | (2006.01) |
| ***A41D 31/18*** | (2019.01) |

(52) U.S. Cl.
CPC ..... *A41C 1/08* (2013.01); *A41D 1/06* (2013.01); *A41D 1/14* (2013.01); *A41D 31/18* (2019.02); *A41D 2400/38* (2013.01)

(58) Field of Classification Search
CPC ... A41D 1/06; A41D 1/08; A41D 1/22; A41D 1/21; A41D 2400/38; A41F 9/025; A41C 1/10; A41C 1/08
See application file for complete search history.

(56) References Cited

U.S. PATENT DOCUMENTS

| | | | | | |
|---|---|---|---|---|---|
| 2,530,132 | A * | 11/1950 | Silvain | A41C 1/10 | 450/134 |
| 2,649,585 | A * | 8/1953 | Blatt | A41C 1/08 | D2/702 |
| 3,214,770 | A * | 11/1965 | Smith | A41D 1/089 | 450/95 |
| 3,806,953 | A * | 4/1974 | Kalil | A41F 9/00 | D2/742 |
| 6,454,628 | B1 * | 9/2002 | Shunichirou | A41C 1/003 | 450/96 |
| 10,455,866 | B2 * | 10/2019 | Hays | A41C 1/08 | |
| 11,166,504 | B2 * | 11/2021 | Otashevich | A41D 31/04 | |
| 11,350,681 | B1 * | 6/2022 | Muhlenfeld | A61F 5/24 | |

(Continued)

*Primary Examiner* — Jillian K Pierorazio

(57) ABSTRACT

A lower garment with an integrated cross-elastic structure includes a lower garment main body, and an abdominal control region is arranged inside the lower garment main body. The abdominal control region includes a first abdominal control panel and a second abdominal control panel. The two panels are arranged in an overlapping manner to form a first overlap region. Top ends of the two panels are fixedly connected to a waistband of the lower garment main body. A first transverse width L1 and a second transverse width L2 are provided between the two panels. The abdominal control region of the lower garment main body is provided with a third transverse width L3 and a fourth transverse width L4. The first transverse width L1 is less than the third transverse width L3, and the second transverse width L2 is not less than the fourth transverse width L4.

20 Claims, 7 Drawing Sheets

(56) References Cited

U.S. PATENT DOCUMENTS

| | | | | |
|---|---|---|---|---|
| 2005/0177920 | A1* | 8/2005 | Wilkinson | A41D 13/0537 2/69 |
| 2012/0180194 | A1* | 7/2012 | Cutter | A41F 9/025 2/237 |
| 2015/0328036 | A1* | 11/2015 | Frangi | A41D 13/0525 602/19 |
| 2016/0045355 | A1* | 2/2016 | Safko | A61F 5/028 602/19 |
| 2016/0050982 | A1* | 2/2016 | Kohrherr | A41C 1/10 450/95 |
| 2017/0013886 | A1* | 1/2017 | Towfigh | A41C 1/08 |
| 2019/0029333 | A1* | 1/2019 | Kohrherr | A41C 1/10 |
| 2019/0246717 | A1* | 8/2019 | Fischer | A41D 27/00 |
| 2019/0320746 | A1* | 10/2019 | Otashevich | A41D 31/04 |
| 2021/0052411 | A1* | 2/2021 | Sarna | A41C 1/10 |
| 2021/0169676 | A1* | 6/2021 | Benhabiles | A41D 1/04 |
| 2022/0338564 | A1* | 10/2022 | Muhlenfeld | A41D 13/0506 |

* cited by examiner

LOWER GARMENT WITH AN INTEGRATED CROSS-ELASTIC STRUCTURE

CROSS-REFERENCE TO RELATED APPLICATIONS

The application claims priority of Chinese patent application CN2025219875704, filed on Sep. 16, 2025, which is incorporated herein by reference in its entirety.

TECHNICAL FIELD

The present invention relates to the technical field of clothing, in particular to a lower garment with an integrated cross-elastic structure.

BACKGROUND ART

With consumers place increasing importance on body shape management, a variety of clothing with abdominal support or abdominal compression function have emerged on the market, such as maternity support pants, body-shaping pants, and form-fitting skirts, etc. Common clothing with abdominal support or abdominal compression function usually utilizes single-layer elastic panels, localized compression, or support methods to apply compression or lifting effects to the abdomen. However, such structure often has the following problems, such as lack of regional differentiation and imprecise compression. In addition, support straps are mostly of single-piece structure, which is prone to deformation or rolling. Moreover, stitching points are concentrated, which fails to effectively utilize the clothing to counteract tension, making it unsuitable for various lower garments (such as skirts).

Based on this, it is necessary to provide a new type of lower garment that adopts two-layer abdominal control panels with crossed abdominal control structure to divide and shape the abdomen under pressure. This structure is stable and can effectively prevent edge roll of the abdominal control panels. At the same time, this abdominal control structure is adaptable to various lower garments, thereby effectively improving wearers' wearing experience and shaping effects.

SUMMARY

In order to overcome the shortcomings of existing technology, a lower garment provided by the present invention adopts a crossed abdominal control structure to divide and press an abdomen for shaping. This structure is stable and adaptable to various lower garments, effectively improving wearers' wearing experience and shaping effects.

The technical solution adopted by the present invention to solve the technical problems is as follows.

The present invention provides a lower garment with an integrated cross-elastic structure. The lower garment with an integrated cross-elastic structure includes a lower garment main body. An abdominal control (i.e., tummy control) region is arranged inside the lower garment main body. The abdominal control region includes a first abdominal control panel and a second abdominal control panel that are arranged in an inner portion of a front side of the lower garment main body. The first abdominal control panel and the second abdominal control panel are arranged in an overlapping manner to form a first overlap region. The first overlap region is configured to conform to the abdomen of the human body, and is configured for enhancing a shaping effect of an abdominal area.

As an improvement of the present invention, the first abdominal control panel and the second abdominal control panel are arranged in an overlapping X-shaped configuration.

As an improvement of the present invention, the first abdominal control panel is a first elastic abdominal control panel, and the second abdominal control panel is a second elastic abdominal control panel.

As an improvement of the present invention, the lower garment main body is an elastic lower garment main body.

As an improvement of the present invention, an elasticity of the first abdominal control panel and an elasticity of the second abdominal control panel are both greater than that of the lower garment main body.

As an improvement of the present invention, the first abdominal control panel is a first mesh abdominal control panel, and the second abdominal control panel is a second mesh abdominal control panel.

As an improvement of the present invention, the first abdominal control panel and the second abdominal control panel have an identical width and an identical length.

As an improvement of the present invention, the lower garment main body includes a first lateral edge and a second lateral edge that are positioned on both sides of the lower garment main body. The first abdominal control panel and the second abdominal control panel are arranged in the overlapping manner on the abdominal control region of the lower garment main body. Both side edges of the first abdominal control panel and the second abdominal control panel are respectively connected to the first lateral edge and the second lateral edge by stitching.

As an improvement of the present invention, top ends of the first abdominal control panel and the second abdominal control panel are respectively connected to a waistband of the lower garment main body.

As an improvement of the present invention, the first abdominal control panel is provided with a first upper edge and a first lower edge. A side of the first upper edge is connected to a first end of the waistband of the lower garment main body. The second abdominal control panel is provided with a second upper edge and a second lower edge. An end of the second upper edge is connected to a second end of the waistband of the lower garment main body.

As an improvement of the present invention, the lower garment further includes a first fixing tab extending upward from an end of the first upper edge, and the first fixing tab is connected to the waistband by stitching.

As an improvement of the present invention, the lower garment further includes a second fixing tab extending upward from an end of the second upper edge, and the second fixing tab is connected to the waistband by stitching.

As an improvement of the present invention, middle portions of the first abdominal control panel and the second abdominal control panel are connected to a middle portion of the lower garment main body.

As an improvement of the present invention, the first abdominal control panel is provided with a first upper extremity and a first lower extremity opposite to the first upper extremity. The second abdominal control panel is provided with a second upper extremity and a second lower extremity opposite to the second upper extremity. A first transverse width L1 is provided between the first upper extremity and the second upper extremity. A second transverse width L2 is provided between the first lower extremity and the second lower extremity.

As an improvement of the present invention, a first side of the abdominal control region of the lower garment main body is provided with a third upper extremity and a third lower extremity. A second side of the abdominal control region of the lower garment main body is provided with a fourth upper extremity and a fourth lower extremity. The first upper extremity is connected to the third upper extremity, and the first lower extremity is connected to the fourth lower extremity. The second upper extremity is connected to the fourth upper extremity, and the second lower extremity is connected to the third lower extremity.

As an improvement of the present invention, a third transverse width L3 is provided between the third upper extremity and the fourth upper extremity. A fourth transverse width L4 is provided between the third lower extremity and the fourth lower extremity.

As an improvement of the present invention, the first transverse width L1 is less than the third transverse width L3, so as to provide a relatively great pressure to the abdomen and enhance the shaping effect for the abdomen.

As an improvement of the present invention, the second transverse width L2 is not less than the fourth transverse width L4, so as to make the lower garment main body remain flat and avoid deformation.

As an improvement of the present invention, fixing buttons are arranged between the first abdominal control panel and the lower garment main body, and fixing buttons are also arranged between the second abdominal control panel and the lower garment main body. The fixing buttons are arranged on top ends and both sides of the first abdominal control panel and the second abdominal control panel, so that the first abdominal control panel and the second abdominal control panel are fixedly connected to the lower garment main body.

As an improvement of the present invention, the lower garment is a pair of pants or a skirt.

The present invention provides a lower garment with an integrated cross-elastic structure. The lower garment with an integrated cross-elastic structure includes the lower garment main body. The abdominal control region is arranged inside the lower garment main body. The abdominal control region includes the first abdominal control panel and the second abdominal control panel that are arranged in the inner portion of the front side of the lower garment main body. The first abdominal control panel and the second abdominal control panel are arranged in an overlapping manner to form the first overlap region. The first overlap region is configured to conform to the abdomen of the human body, so as to form a localized crossed support force to effectively compress and support abdominal fat and muscle, thereby enhancing abdominal compression and shaping effects. The first overlap region is configured for enhancing the shaping effect of the abdominal area.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
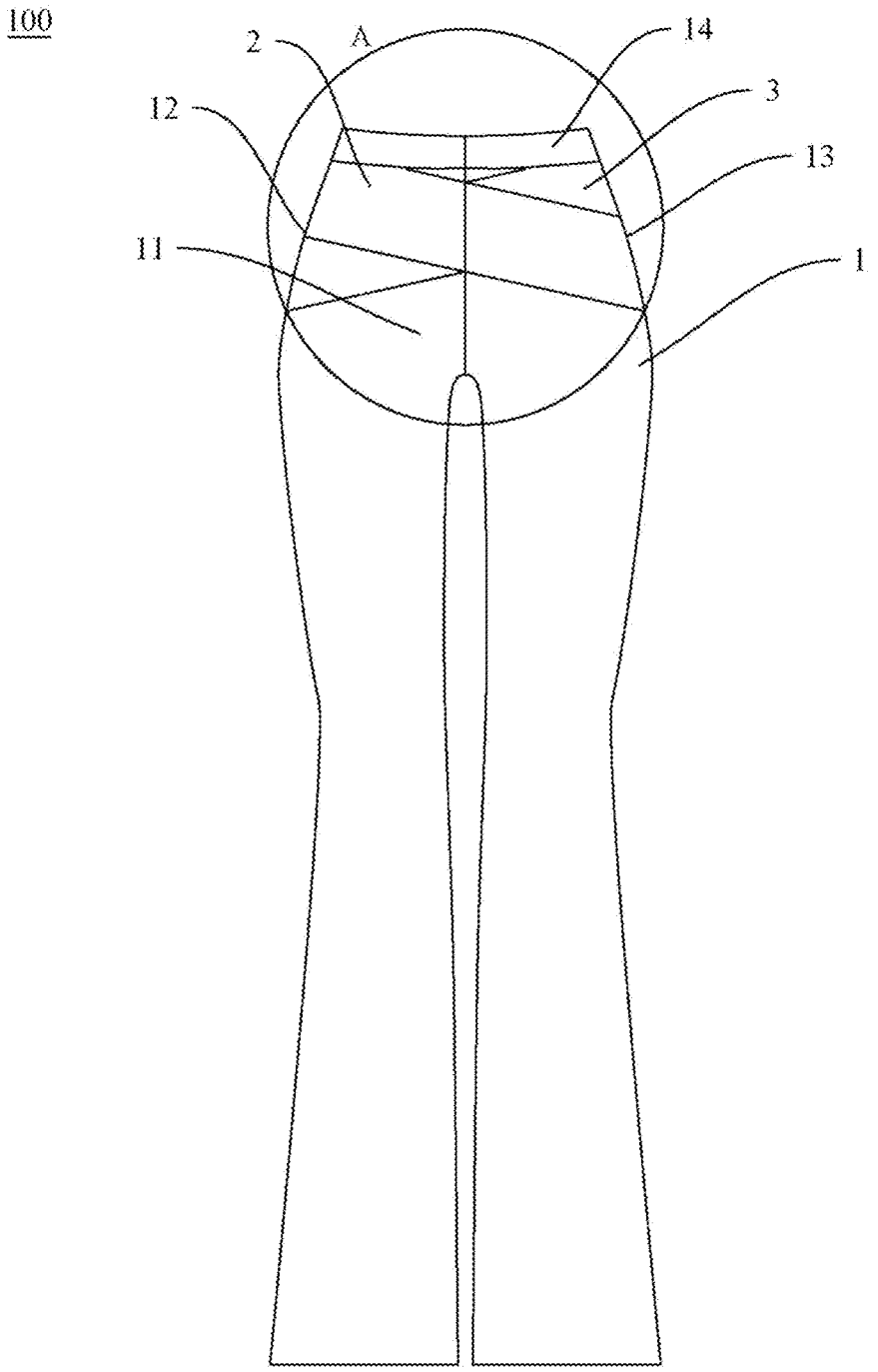
FIG. 1 is a structural diagram of an abdominal control region inside a lower garment main body.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
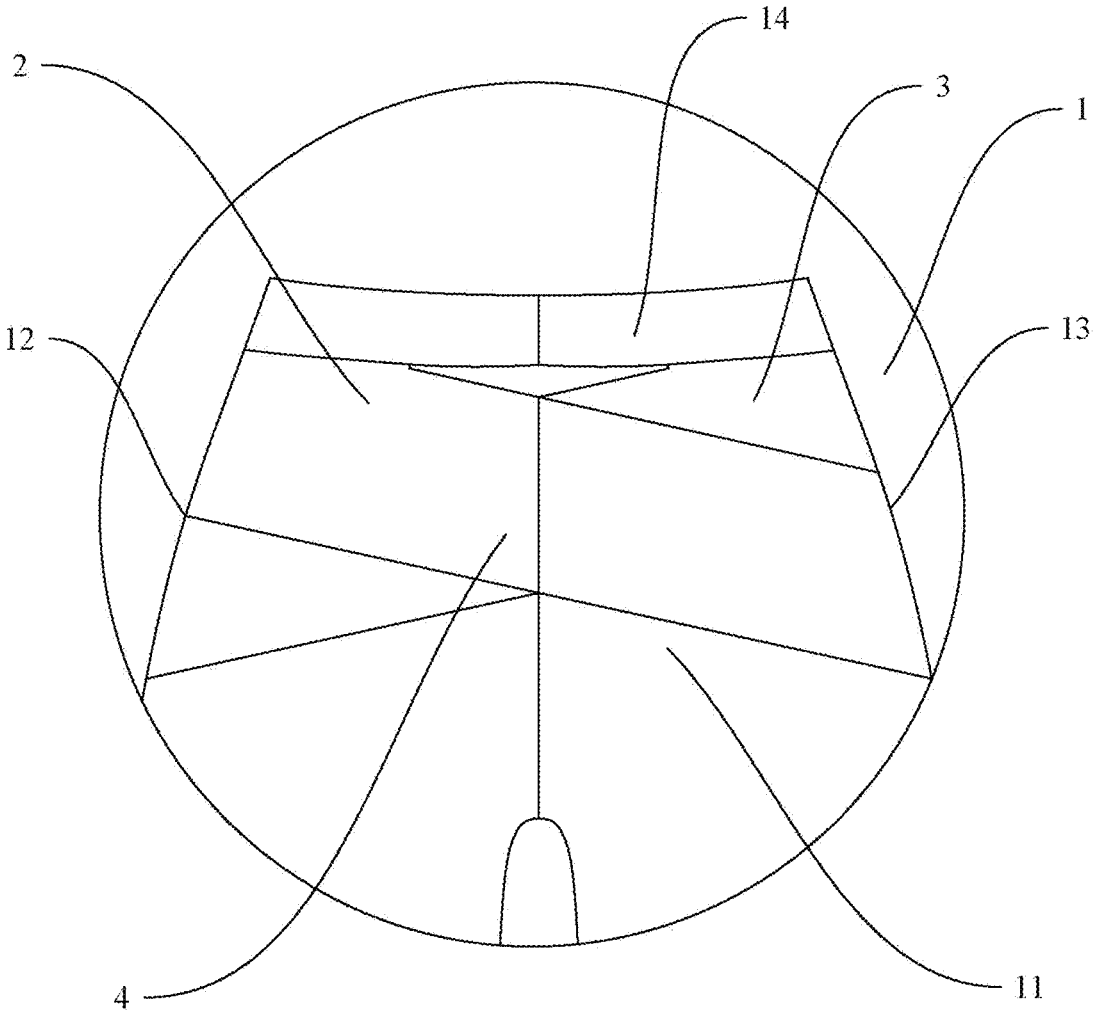
FIG. 2 is a partial enlarged structural diagram of area A in FIG. 1.

Referring to FIG. 1-FIG. 2, a lower garment with an integrated cross-elastic structure 100 provided by the present invention includes a lower garment main body 1. An abdominal control (i.e., tummy control) region 11 is arranged inside the lower garment main body 1. The abdominal control region 11 includes a first abdominal control panel 2 and a second abdominal control panel 3 that are arranged in an inner portion of a front side of the lower garment main body 1. The first abdominal control panel 2 and the second abdominal control panel 3 are arranged in an overlapping manner to form a first overlap region 4. The first overlap region 4 is configured to conform to an abdomen of the human body, so as to form a localized crossed support force to effectively compress and support abdominal fat and muscle, thereby enhancing abdominal compression and shaping effects. The first overlap region 4 is configured for enhancing a shaping effect of an abdominal area.

As a preferable option of this embodiment, the first abdominal control panel 2 and the second abdominal control panel 3 are arranged in an overlapping X-shaped configuration. The overlapping X-shaped configuration forms an elastic tensile force in both longitudinal and transverse directions. Therefore, this can provide multi-directional wrapping and compression of the abdomen, making the shaping effect more balanced and three-dimensional.

In this embodiment, the first abdominal control panel 2 is a first elastic abdominal control panel 2, and the second abdominal control panel 3 is a second elastic abdominal control panel 3. The elastic abdominal control panels avoid the constricting feeling and sense of restraint caused by traditional rigid abdominal control panels, allowing wearers to feel comfortable during long-term wearing. The first elastic abdominal control panel 2 and the second elastic abdominal control panel 3 are configured to overlap to form an elastic crossed support force, further enhancing the shaping effect of the abdominal area.

In this embodiment, the lower garment main body 1 is an elastic lower garment main body 1. The abdomen and waist are wrapped continuously by the elastic lower garment main body 1, the internal first elastic abdominal control panel 2, and the internal second elastic abdominal control panel 3. Moreover, this provides elastic support force, so as to achieve a more balanced and natural shaping effect.

In this embodiment, an elasticity of the first abdominal control panel 2 and an elasticity of the second abdominal control panel 3 are both greater than that of the lower garment main body 1. Due to the relatively high elasticity of the first abdominal control panel 2 and the second abdominal control panel 3, targeted compression on the abdominal area is formed, thereby improving the shaping effect.

In this embodiment, the first abdominal control panel 2 is a first mesh abdominal control panel 2, and the second abdominal control panel 3 is a second mesh abdominal control panel 3. Mesh material has high air permeability, which can effectively reduce heat buildup and perspiration accumulation on the abdominal area, thereby improving the comfort of long-term wearing.

In this embodiment, the first abdominal control panel 2 and the second abdominal control panel 3 have an identical width and an identical length. Through the above structure, uniform elastic tension can be formed on the first overlap region 4, so as to avoid localized pressure concentration or uneven shaping caused by size differences.

In this embodiment, referring to FIG. 1-FIG. 2, the lower garment main body 1 includes a first lateral edge 12 and a second lateral edge 13 that are positioned on both sides of the lower garment main body 1. The first abdominal control panel 2 and the second abdominal control panel 3 are arranged in the overlapping manner on the abdominal control region 11 of the lower garment main body 1. Both side edges of the first abdominal control panel 2 and the second abdominal control panel 3 are respectively connected to the first lateral edge 12 and the second lateral edge 13 by stitching. Through the above structure, it is possible to effectively prevent the abdominal control panels from shifting, rolling, or bunching during wear or movement, thereby ensuring a stable and long-lasting shaping effect.

Figure 3:
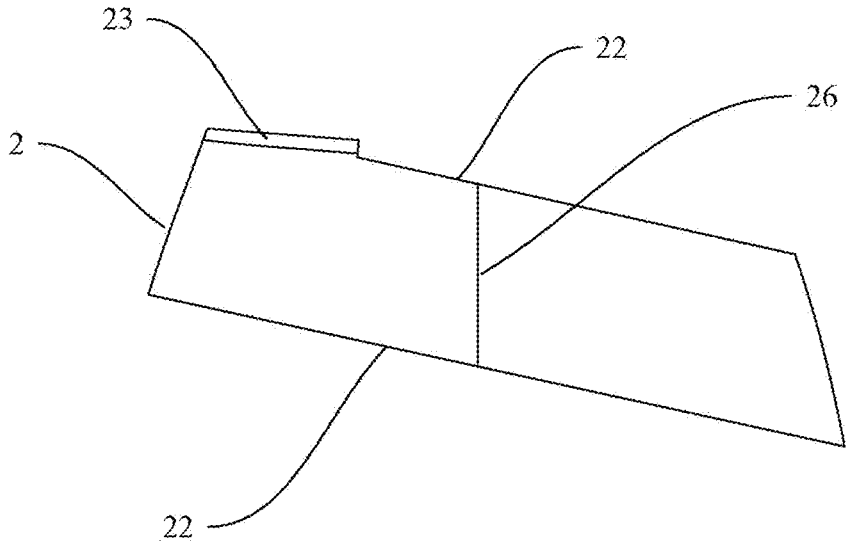
FIG. 3 is a structural diagram of a first abdominal control panel.

In this embodiment, referring to FIG. 2-FIG. 3, top ends of the first abdominal control panel 2 and the second abdominal control panel 3 are respectively connected to a waistband 14 of the lower garment main body 1.

Specifically, the first abdominal control panel 2 is provided with a first upper edge 21 and a first lower edge 22. A side of the first upper edge 21 is connected to a first end of the waistband 14 of the lower garment main body 1. The second abdominal control panel 3 is provided with a second upper edge 31 and a second lower edge 32. An end of the second upper edge 31 is connected to a second end of the waistband 14 of the lower garment main body 1. As a preferable option, the lower garment further includes a first fixing tab 23 extending upward from an end of the first upper edge 21, and the first fixing tab 23 is connected to the waistband 14 by stitching. The lower garment further includes a second fixing tab 24 extending upward from an end of the second upper edge 31, and the second fixing tab 24 is connected to the waistband 14 by stitching. Through the above structure, the first abdominal control panel 2 and the second abdominal control panel 3 are firmly connected to the lower garment main body 1, so as to avoid sliding down, shifting, or rolling during wear or movement.

Figure 4:
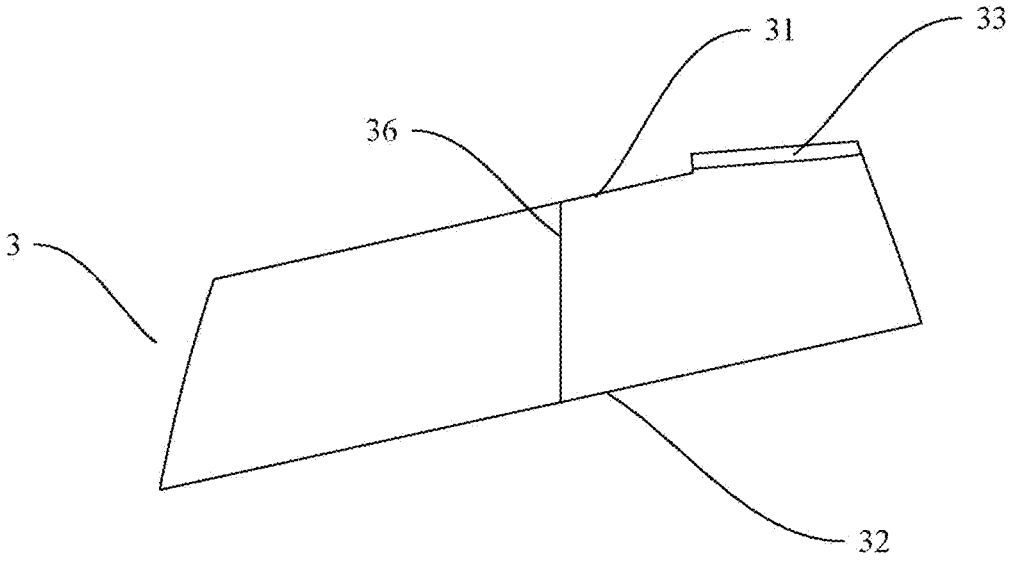
FIG. 4 is a structural diagram of a second abdominal control panel.

In this embodiment, referring to FIG. 3-FIG. 4, middle portions of the first abdominal control panel 2 and the second abdominal control panel 3 are connected to a middle portion of the lower garment main body 1. Specifically, the middle portion of the first abdominal control panel 2 is provided with a first stitching portion 26, and the middle portion of the second abdominal control panel 3 is provided with a second stitching portion 36. The first stitching portion 26 and the second stitching portion 36 are arranged corresponding to a third stitching portion 15 on a middle portion of the front side of the lower garment main body 1. In addition, the first stitching portion 26 and the second stitching portion 36 are mutually connected to the third stitching portion 15 by stitching. Through the above structure, the first abdominal control panel 2 and the second abdominal control panel 3 are firmly connected to the lower garment main body 1, so as to avoid sliding down, shifting, or rolling during wear or movement, thereby further enhance the abdominal compression effect.

In this embodiment, a gap 17 is positioned between the waistband 14 and tops of the middle portions of both the first abdominal control panel 2 and the second abdominal control panel 3. The gap 17 is capable of preventing the first abdominal control panel 2 and the second abdominal control panel 3 from being excessively pulled or pressed at a lower edge of the waistband 14. Therefore, this reduces the sense of restraint on the waist, and improves the comfort of long-term wearing.

Figure 5:
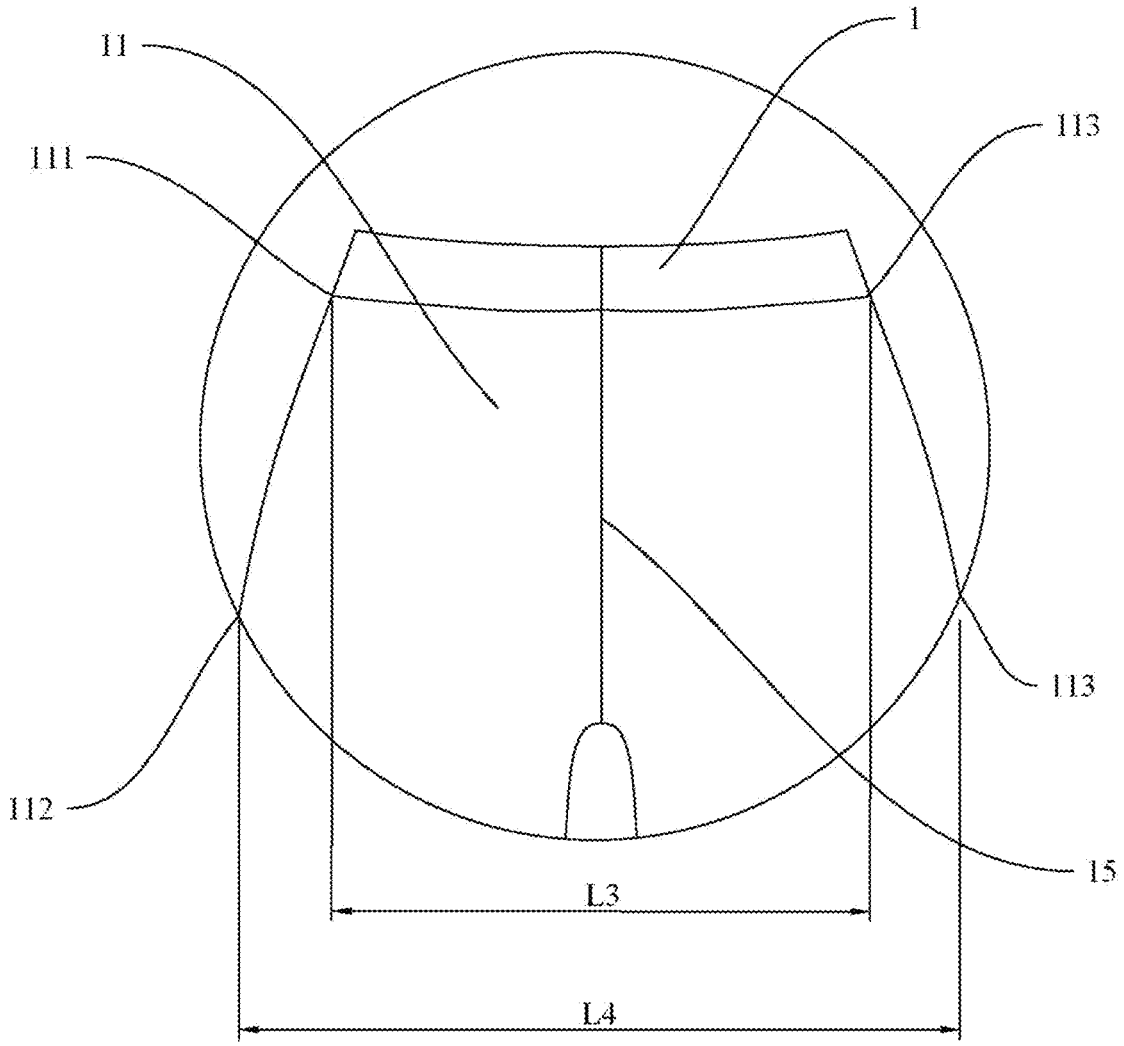
FIG. 5 is a partial enlarged structural diagram of the abdominal control region inside the lower garment main body.
Figure 6:
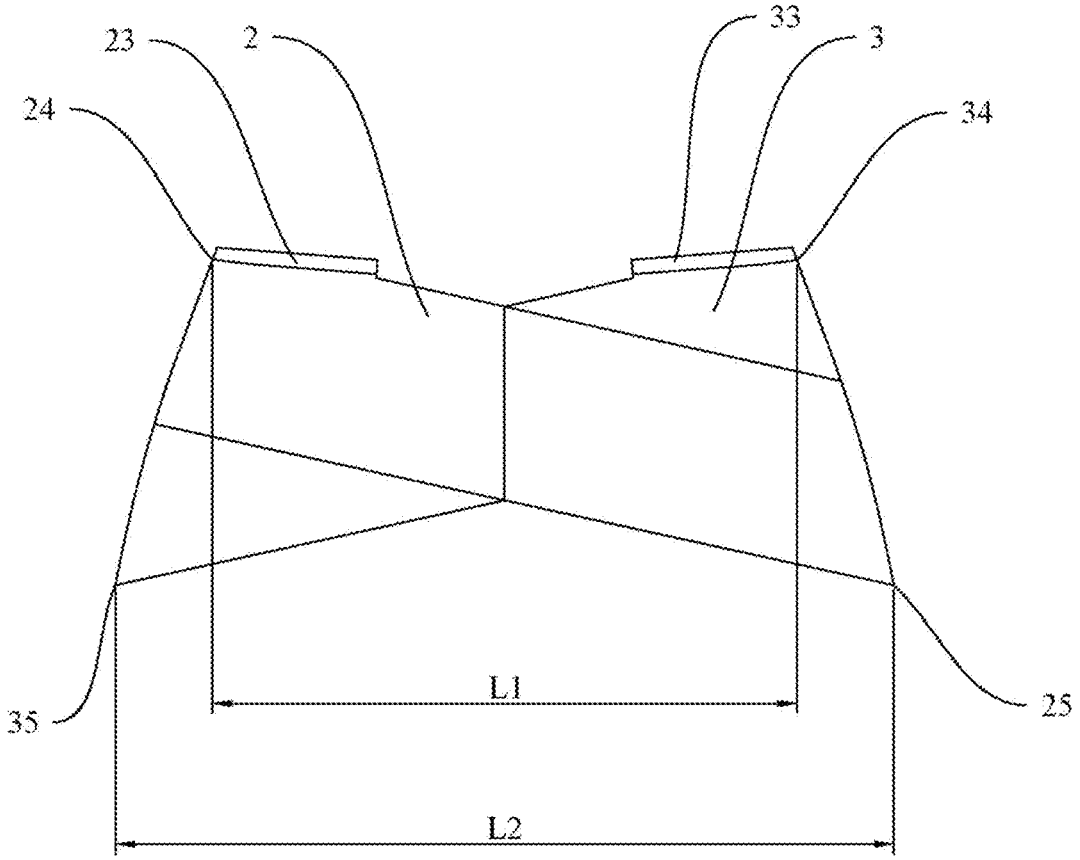
FIG. 6 is a partial enlarged structural diagram showing the overlapping arrangement between the first abdominal control panel and the second abdominal control panel.

In this embodiment, referring to FIG. 4-FIG. 5, the first abdominal control panel 2 is provided with a first upper extremity 24 and a first lower extremity 25 opposite to the first upper extremity 24. The second abdominal control panel 3 is provided with a second upper extremity 34 and a second lower extremity 35 opposite to the second upper extremity 34. A first transverse width L1 is provided between the first upper extremity 24 and the second upper extremity 34. A second transverse width L2 is provided between the first lower extremity 25 and the second lower extremity 35. A first side of the abdominal control region 11 of the lower garment main body 1 is provided with a third upper extremity 111 and a third lower extremity 112. A second side of the abdominal control region 11 of the lower garment main body 1 is provided with a fourth upper extremity 114 and a fourth lower extremity 115. The first upper extremity 24 is connected to the third upper extremity 111, and the first lower extremity 25 is connected to the fourth lower extremity 115. The second upper extremity 34 is connected to the fourth upper extremity 114, and the second lower extremity 35 is connected to the third lower extremity 112. A third transverse width L3 is provided between the third upper extremity 111 and the fourth upper extremity 114. A fourth transverse width L4 is provided between the third lower extremity 112 and the fourth lower extremity 115. The first transverse width L1 is less than the third transverse width L3, so as to provide a relatively great pressure to the abdomen and enhance the shaping effect for the abdomen. The second transverse width L2 is not less than the fourth transverse width L4. Therefore, main body of summer outfit is prevented from being excessively pulled, so as to avoid wrinkles, bulges, or deformation, thereby maintaining a smooth and aesthetic appearance.

Figure 7:
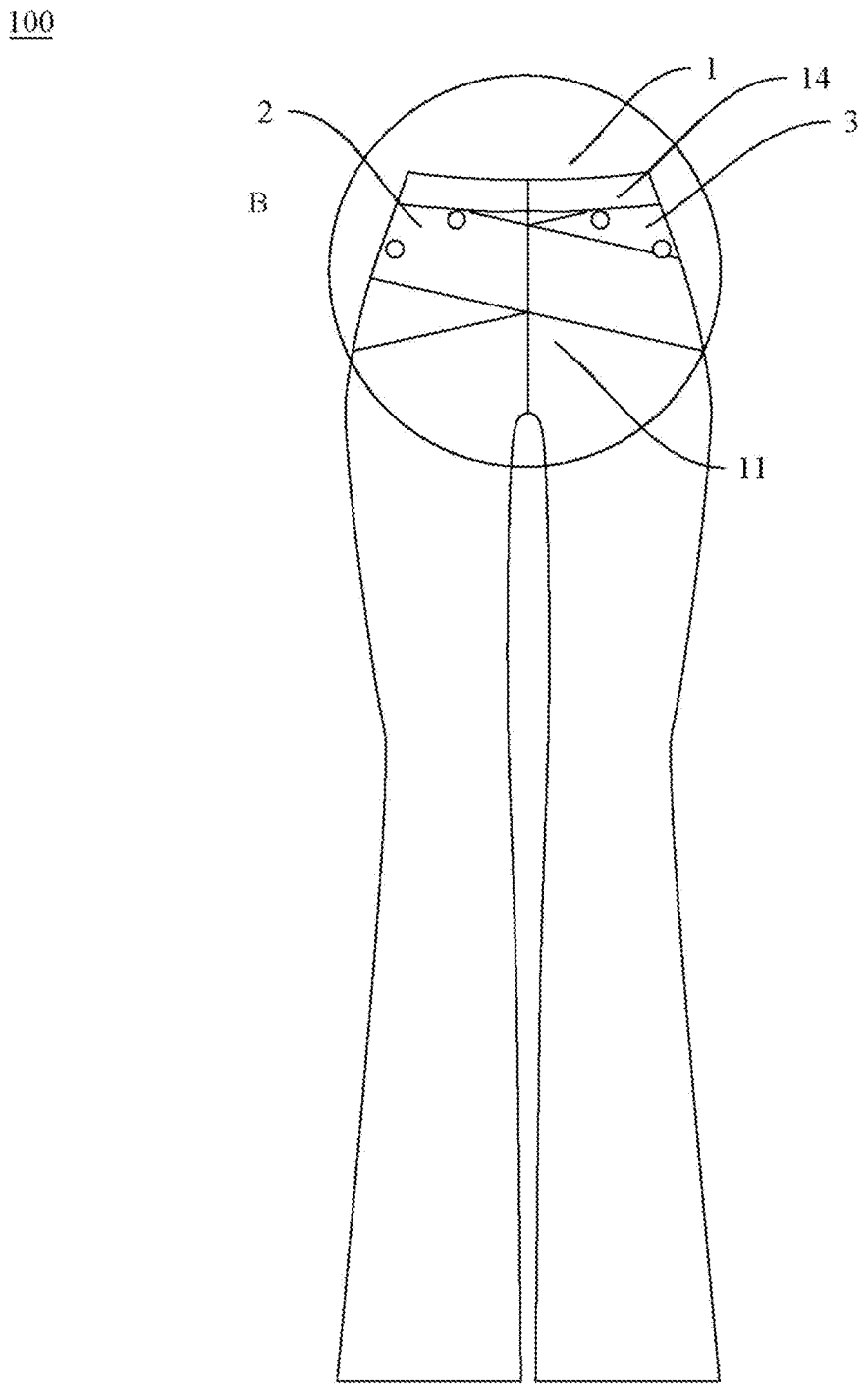
FIG. 7 is a structural diagram showing that the first abdominal control panel and the second abdominal control panel are connected to an inner portion of the lower garment main body via fixing buttons.
Figure 8:
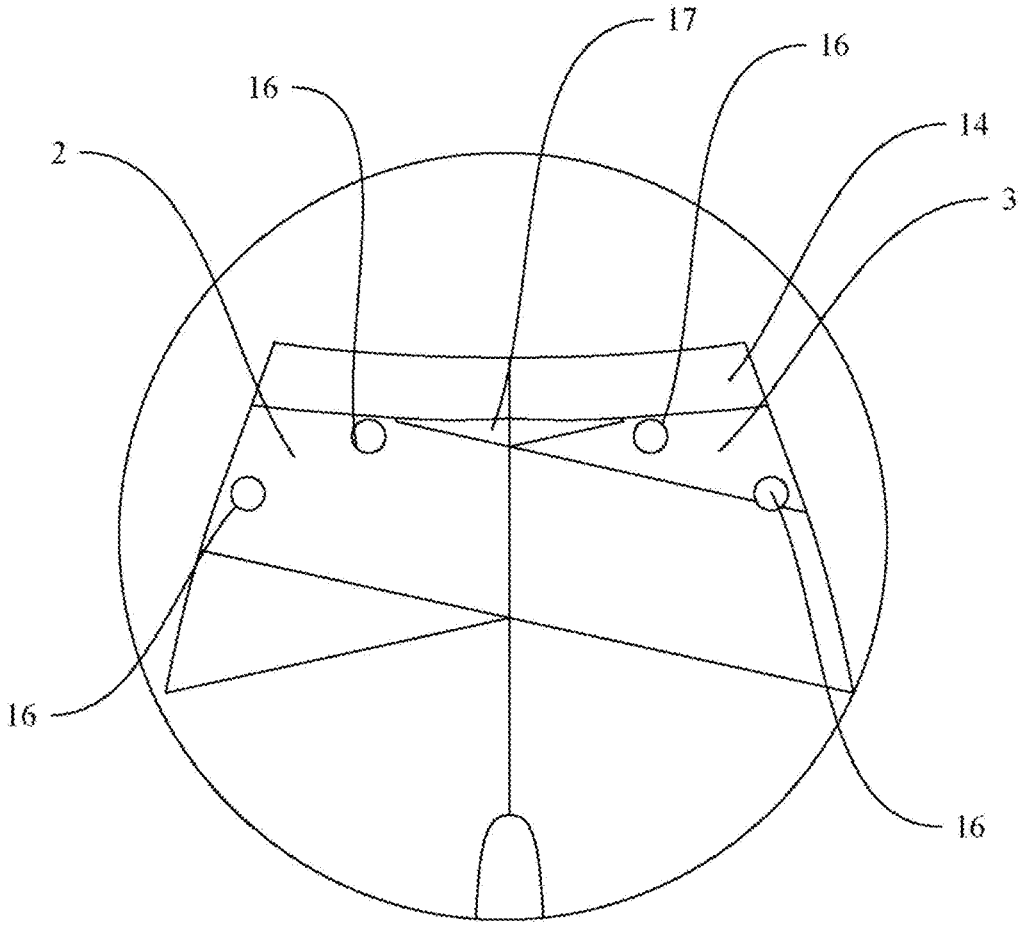
FIG. 8 is a partial enlarged structural diagram of area B in FIG. 7.

In this embodiment, referring to FIG. 7-FIG. 8, fixing buttons 16 are arranged between the first abdominal control panel 2 and the lower garment main body 1, and fixing buttons 16 are also arranged between the second abdominal control panel 3 and the lower garment main body 1. The fixing buttons 16 are arranged on top ends and both sides of the first abdominal control panel 2 and the second abdominal control panel 3, so that the first abdominal control panel 2 and the second abdominal control panel 3 are fixedly connected to the lower garment main body 1. Through the above structure, it is possible to effectively prevent the first abdominal control panel 2 and the second abdominal control panel 3 from shifting, sliding down, or rolling during wear or movement, thereby ensuring the long-lasting and stable shaping effect.

In this embodiment, the lower garment is a pair of pants or a skirt, so as to meet different users' needs.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A lower garment with an integrated cross-elastic structure, comprising:

a lower garment main body, an abdominal control region being arranged inside the lower garment main body;

wherein the abdominal control region comprises a first abdominal control panel and a second abdominal control panel that are arranged in an inner portion of a front side of the lower garment main body, the first abdominal control panel and the second abdominal control panel are arranged in an overlapping manner to form a first overlap region, the first overlap region is configured to conform to an abdomen of the human body, and the first overlap region is configured for enhancing a shaping effect of an abdominal area;

wherein the first abdominal control panel is provided with a first upper extremity and a first lower extremity opposite to the first upper extremity, the second abdominal control panel is provided with a second upper extremity and a second lower extremity opposite to the second upper extremity, a first transverse width L1 is provided between the first upper extremity and the second upper extremity, and a second transverse width L2 is provided between the first lower extremity and the second lower extremity.

2. The lower garment with an integrated cross-elastic structure according to claim 1, wherein the first abdominal control panel and the second abdominal control panel are arranged in an overlapping X-shaped configuration.

3. The lower garment with an integrated cross-elastic structure according to claim 1, wherein the first abdominal control panel is a first elastic abdominal control panel, and the second abdominal control panel is a second elastic abdominal control panel.

4. The lower garment with an integrated cross-elastic structure according to claim 1, wherein the lower garment main body is an elastic lower garment main body.

5. The lower garment with an integrated cross-elastic structure according to claim 4, wherein an elasticity of the first abdominal control panel and an elasticity of the second abdominal control panel are both greater than that of the lower garment main body.

6. The lower garment with an integrated cross-elastic structure according to claim 1, wherein the first abdominal control panel is a first mesh abdominal control panel, and the second abdominal control panel is a second mesh abdominal control panel.

7. The lower garment with an integrated cross-elastic structure according to claim 1, wherein the first abdominal control panel and the second abdominal control panel have an identical width and an identical length.

8. The lower garment with an integrated cross-elastic structure according to claim 1, wherein the lower garment main body comprises a first lateral edge and an opposite second lateral edge, the first abdominal control panel and the second abdominal control panel are arranged in the overlapping manner on the abdominal control region of the lower garment main body, and the first abdominal control panel and the second abdominal control panel are respectively connected to the first lateral edge and the second lateral edge by stitching.

9. The lower garment with an integrated cross-elastic structure according to claim 1, wherein top ends of the first abdominal control panel and the second abdominal control panel are respectively connected to a waistband of the lower garment main body.

10. The lower garment with an integrated cross-elastic structure according to claim 9, wherein the first abdominal control panel is provided with a first upper edge and a first lower edge, a side of the first upper edge is connected to a first end of the waistband of the lower garment main body, the second abdominal control panel is provided with a second upper edge and a second lower edge, and an end of the second upper edge is connected to a second end of the waistband of the lower garment main body.

11. The lower garment with an integrated cross-elastic structure according to claim 10, wherein the lower garment main body further comprises a first fixing tab extending upward from an end of the first upper edge, and the first fixing tab is connected to the waistband by stitching.

12. The lower garment with an integrated cross-elastic structure according to claim 10, wherein the lower garment further comprises a second fixing tab extending upward from an end of the second upper edge, and the second fixing tab is connected to the waistband by stitching.

13. The lower garment with an integrated cross-elastic structure according to claim 1, wherein middle portions of the first abdominal control panel and the second abdominal control panel are connected to a middle portion of the lower garment main body.

14. The lower garment with an integrated cross-elastic structure according to claim 1, wherein a first side of the abdominal control region of the lower garment main body is provided with a third upper extremity and a third lower extremity, and a second side of the abdominal control region of the lower garment main body is provided with a fourth upper extremity and a fourth lower extremity; the first upper extremity is connected to the third upper extremity, the first lower extremity is connected to the fourth lower extremity, the second upper extremity is connected to the fourth upper extremity, and the second lower extremity is connected to the third lower extremity.

15. The lower garment with an integrated cross-elastic structure according to claim 14, wherein a third transverse width L3 is provided between the third upper extremity and the fourth upper extremity, and a fourth transverse width L4 is provided between the third lower extremity and the fourth lower extremity.

16. The lower garment with an integrated cross-elastic structure according to claim 15, wherein the first transverse width L1 is less than the third transverse width L3, so as to provide a relatively great pressure to the abdomen and enhance the shaping effect for the abdomen.

17. The lower garment with an integrated cross-elastic structure according to claim 15, wherein the second transverse width L2 is not less than the fourth transverse width L4, so as to make the lower garment main body remain flat and avoid deformation.

18. The lower garment with an integrated cross-elastic structure according to claim 1, wherein fixing buttons are arranged between the first abdominal control panel and the lower garment main body, and fixing buttons are also arranged between the second abdominal control panel and the lower garment main body; the fixing buttons are arranged on top ends of the first abdominal control panel and the second abdominal control panel, so that the first abdominal control panel and the second abdominal control panel are fixedly connected to the lower garment main body.

19. A lower garment with an integrated cross-elastic structure, comprising:

a lower garment main body, an abdominal control region being arranged inside the lower garment main body;

wherein the abdominal control region comprises a first abdominal control panel and a second abdominal control panel that are arranged in an inner portion of a front side of the lower garment main body, the first abdominal control panel and the second abdominal control panel are arranged in an overlapping manner to form a first overlap region, the first overlap region is configured to conform to an abdomen of the human body, and the first overlap region is configured for enhancing a shaping effect of an abdominal area;

wherein the first abdominal control panel is provided with a first upper edge and a first lower edge;

wherein the lower garment main body further comprises a first fixing tab extending upward from an end of the first upper edge, and the first fixing tab is connected to the waistband by stitching.

20. A lower garment with an integrated cross-elastic structure, comprising:

a lower garment main body, an abdominal control region being arranged inside the lower garment main body;

wherein the abdominal control region comprises a first abdominal control panel and a second abdominal control panel that are arranged in an inner portion of a front side of the lower garment main body, the first abdominal control panel and the second abdominal control panel are arranged in an overlapping manner to form a first overlap region, the first overlap region is configured to conform to an abdomen of the human body, and the first overlap region is configured for enhancing a shaping effect of an abdominal area;

wherein the first abdominal control panel and the second abdominal control panel are separate from each other;

wherein the lower garment main body comprises a first lateral edge and an opposite second lateral edge, the first abdominal control panel and the second abdominal control panel are arranged in the overlapping manner on the abdominal control region of the lower garment main body, and the first abdominal control panel and the second abdominal control panel are respectively connected to the first lateral edge and the second lateral edge by stitching.

* * * * *